US010344662B2

(12) United States Patent
Yin et al.

(10) Patent No.: US 10,344,662 B2
(45) Date of Patent: Jul. 9, 2019

(54) INTELLIGENT SEAWATER COOLING SYSTEM

(71) Applicant: CIRCOR PUMPS NORTH AMERICA, LLC, Monroe, NC (US)

(72) Inventors: Dan Yin, Waxhaw, NC (US); Stefan Werner, Allensbach (DE); Soeren Lemcke, Gundholzen-Gaienhofen (DE)

(73) Assignee: CIRCOR PUMPS NORTH AMERICA, LLC, Monroe, NC (US)

( * ) Notice: Subject to any disclaimer, the term of this patent is extended or adjusted under 35 U.S.C. 154(b) by 0 days.

(21) Appl. No.: 15/505,460

(22) PCT Filed: Aug. 3, 2015

(86) PCT No.: PCT/US2015/043355

§ 371 (c)(1),
(2) Date: Feb. 21, 2017

(87) PCT Pub. No.: WO2016/028474

PCT Pub. Date: Feb. 25, 2016

(65) Prior Publication Data

US 2017/0241323 A1 Aug. 24, 2017

Related U.S. Application Data

(60) Provisional application No. 62/040,089, filed on Aug. 21, 2014.

(51) Int. Cl.
*F01P 3/20* (2006.01)
*F01P 5/10* (2006.01)
(Continued)

(52) U.S. Cl.
CPC ..... *F01P 3/207* (2013.01); *B63H 21/383* (2013.01); *F01P 5/10* (2013.01); *F01P 7/164* (2013.01);
(Continued)

(58) Field of Classification Search
CPC .... F01P 3/207; F01P 5/10; F01P 11/16; F01P 7/164; F01P 11/18; F01P 2050/02; F01P 2005/105; B63H 21/383
See application file for complete search history.

(56) References Cited

U.S. PATENT DOCUMENTS 4,600,049 A * 7/1986 Nilsson ..... F01P 3/20 165/295
2005/0150143 A1* 7/2005 Charles ..... F04B 49/06 37/414
(Continued)

FOREIGN PATENT DOCUMENTS

CN 201041072 Y 3/2008
CN 101333957 A 12/2008
(Continued)

OTHER PUBLICATIONS

International Search Report and Written Opinion dated Jan. 14, 2016 for PCT/US2015/043355 filed Aug. 3, 2015.

*Primary Examiner* — Jacob M Amick
*Assistant Examiner* — Charles Brauch

(57) ABSTRACT

A seawater cooling system adapted to mitigate salt crystallization in a seawater cooling loop. The system may include a pump operatively connected to the cooling loop and configured to pump seawater through the cooling loop, a temperature sensor operatively connected to the cooling loop and configured to monitor a temperature of the seawater in the cooling loop, and a controller operatively connected to the temperature sensor and to the pump, the controller configured to issue a warning and to increase a speed of the pump if it is determined that the monitored temperature of the seawater exceeds a predetermined threshold temperature.

8 Claims, 8 Drawing Sheets

(51) Int. Cl.

| | |
|---|---|
| ***F01P 7/16*** | (2006.01) |
| ***B63H 21/38*** | (2006.01) |
| ***F01P 11/16*** | (2006.01) |
| ***F01P 11/18*** | (2006.01) |

(52) U.S. Cl.
CPC ..... *F01P 11/16* (2013.01); *F01P 11/18* (2013.01); *F01P 3/205* (2013.01); *F01P 7/165* (2013.01); *F01P 2005/105* (2013.01); *F01P 2050/02* (2013.01); *F01P 2050/06* (2013.01)

(56) References Cited

U.S. PATENT DOCUMENTS

| | | | | |
|---|---|---|---|---|
| 2006/0162781 | A1* | 7/2006 | Blomgren | F16K 11/074 137/311 |
| 2012/0317958 | A1* | 12/2012 | Karcher | F02B 37/007 60/273 |

FOREIGN PATENT DOCUMENTS

| | | | | | |
|---|---|---|---|---|---|
| CN | 101560906 | A | | 10/2009 | |
| CN | 203706376 | U | * | 7/2014 | |
| EP | 0122113 | A2 | | 10/1984 | |
| GB | 868345 | A | | 5/1961 | |
| JP | S55-102017 | | | 7/1980 | |
| JP | S58-144024 | U | | 9/1983 | |
| JP | 62288309 | A | * | 12/1987 | F01P 7/164 |
| JP | S62288309 | A | | 12/1987 | |
| JP | 2000-145651 | A | | 5/2000 | |
| JP | 2011-122771 | A | | 6/2011 | |
| JP | 2012-122371 | A | | 6/2012 | |
| JP | 5323584 | B2 | | 7/2013 | |
| JP | 2014046910 | A | | 3/2014 | |
| WO | 2009139201 | A1 | | 11/2009 | |

* cited by examiner

INTELLIGENT SEAWATER COOLING SYSTEM

CROSS-REFERENCE TO RELATED APPLICATIONS

This is a non-provisional of pending U.S. Provisional Patent Application Ser. No. 62/040,089, filed Aug. 21, 2014, the entirety of which application is incorporated by reference herein.

FIELD OF THE DISCLOSURE

The disclosure is generally related to the field of seawater cooling systems, and more particularly to a system and method for controlling the temperature in a fresh water cooling loop by regulating pump speed in a seawater cooling loop thermally coupled thereto.

BACKGROUND OF THE DISCLOSURE

Large seafaring vessels are commonly powered by large internal combustion engines that require continuous cooling under various operating conditions, such as during high speed cruising, low speed operation when approaching ports, and full speed operation for avoiding bad weather, for example. Existing systems for achieving such cooling typically include one or more pumps that draw seawater into heat exchangers onboard a vessel. The heat exchangers are used to cool a closed, fresh water cooling loop that flows through and cools the engine(s) of the vessel and/or other various loads onboard the vessel (e.g., air conditioning systems).

A shortcoming associated with existing seawater cooling systems such as that described above is that they are generally inefficient. Particularly, the pumps that are employed to draw seawater into such systems are typically operated at a constant speed regardless of the amount of seawater necessary to achieve sufficient cooling of the associated engine. Thus, if an engine does not require a great deal of cooling, such as when the engine is idling or is operating at low speeds, or if the seawater being drawn into a cooling system is very cold, the pumps of the cooling system may provide more water than is necessary to achieve sufficient cooling. In such cases, the cooling system will be configured to divert an amount of the fresh water in the fresh water loop directly to the discharge side of the heat exchangers, where it mixes with the rest of the fresh water that flowed through, and was cooled by, the heat exchangers. A desired temperature in the fresh water loop is thereby achieved. However, the system does not often require the full cooling power provided by seawater pumps driven at constant speed (hence the need to divert water in the fresh water loop). A portion of the energy expended to drive the pumps is therefore wasted. Thus, there is a need for a more efficient seawater pumping system for use in heat exchange systems servicing the marine industry.

SUMMARY

A seawater cooling system is disclosed for mitigating salt crystallization in a seawater cooling loop. The system can include a pump operatively connected to the cooling loop and configured to pump seawater through the cooling loop. A temperature sensor can be operatively connected to the cooling loop and configured to monitor a temperature of the seawater in the cooling loop. A controller can be operatively connected to the temperature sensor and to the pump. The controller can be configured to increase a speed of the pump when the controller determines, from a signal received from the temperature sensor, that a monitored temperature of the seawater exceeds a predetermined threshold temperature.

A method is disclosed for mitigating salt crystallization in a seawater cooling loop. The method can include: measuring a temperature of seawater in the cooling loop; comparing the measured temperature of the seawater to a predetermined threshold temperature; and increasing a speed of a pump circulating the seawater through the cooling loop when the measured temperature of the seawater exceeds the predetermined threshold temperature.

A seawater cooling system is disclosed for monitoring and reducing clogging in a seawater cooling loop. The system can include a pressure sensor operatively connected to the cooling loop and configured to measure a fluid pressure of seawater in the cooling loop. A plurality of valves may be connected to the cooling loop and configured to selectively change a flow direction of the seawater through the cooling loop between a first direction, during normal operation, and second direction opposite the first direction, during a back flushing operation. A controller can be operatively connected to the pressure sensor and to the plurality of valves, the controller configured to operate the plurality of valves to change flow from the first direction to the second direction when the pressure of the seawater exceeds a pressure level associated with a predetermined maximum clogging level.

A method for monitoring and reducing clogging in a seawater cooling loop is disclosed. The method can comprise: circulating seawater through the cooling loop using a pump operating at a predetermined speed; measuring a pressure of the seawater while the pump is operated at the predetermined speed; comparing the measured pressure to a predetermined pressure, the predetermined pressure associated with a baseline condition of the cooling loop; and reversing the circulation direction of the seawater through the cooling loop when the measured pressure exceeds the predetermined pressure by a predetermined amount.

An overlapping pump system is disclosed. The system can comprise first and second pumps coupled to a seawater cooling loop for circulating seawater through the seawater cooling loop, and first and second controllers operatively coupled to the first and second pumps, respectively. The first and second controllers may be configured to perform a handshake operation for switching operation between the first and second pumps. The handshake operation may include: sending, from the first controller to the second controller, a request for the second controller to start operation of the second pump, upon receipt of the request, sending, from the second controller, an acknowledgement to the first controller when the second pump is capable of starting operation, and upon receiving, at the first controller, the acknowledgement, the first controller shutting down the first pump.

A method for overlapping operation of a first pump and a second pump is disclosed. The method may comprise: sending, from a first controller coupled to the first pump, a request to a second controller coupled to the second pump, a request for the second controller to start operation of the second pump; upon receipt of the request, sending, from the second controller, an acknowledgement to the first controller when the second pump is capable of starting operation; and upon receiving, at the first controller, the acknowledgement, shutting down the first pump.

BRIEF DESCRIPTION OF THE DRAWINGS

By way of example, specific embodiments of the disclosed device will now be described, with reference to the accompanying drawings, in which.

DETAILED DESCRIPTION

Figure 1:
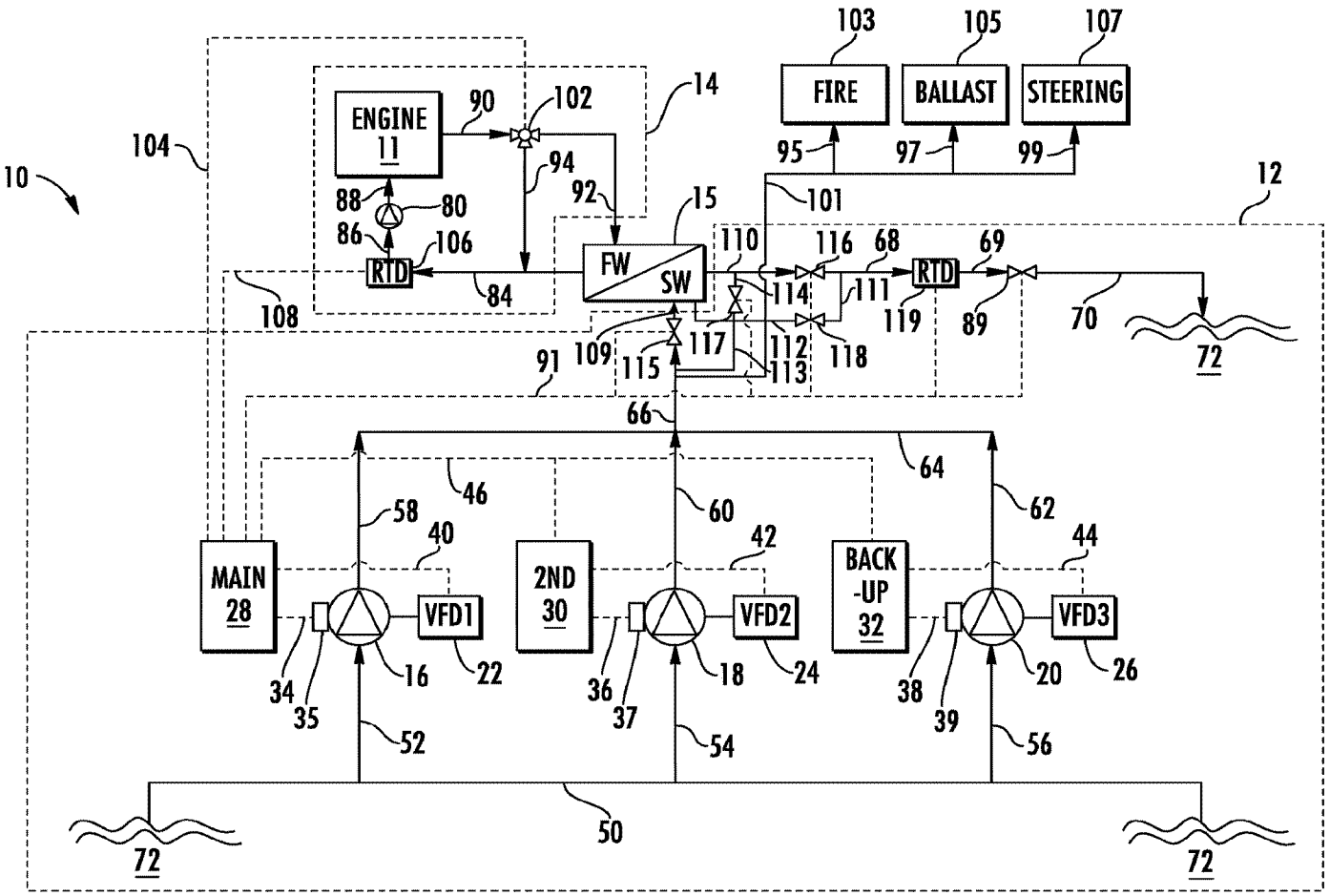
FIG. 1 is a schematic view illustrating an exemplary intelligent seawater cooling system in accordance system.

An intelligent seawater cooling system and method in accordance with the present disclosure will now be described more fully hereinafter with reference to the accompanying drawings, in which preferred embodiments of the system and method are shown. The disclosed system and method, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

Referring to FIG. 1, a schematic representation of an exemplary intelligent seawater cooling system 10 (hereinafter "the system 10") is shown. The system 10 may be installed onboard any type of seafaring vessel or offshore platform having one or more engines 11 that require cooling. Only a single engine 11 is shown in FIG. 1, but it will be appreciated by those of ordinary skill in the art the engine 11 may be representative of a plurality of engines or various other loads onboard a vessel or platform that may be coupled to the cooling system 10.

The system 10 may include a seawater cooling loop 12 and a fresh water cooling loop 14 that are thermally coupled to one another by a heat exchanger 15 as further described below. Only a single heat exchanger 15 is shown in FIG. 1, but it is contemplated that the system 10 may alternatively include two or more heat exchangers for providing greater thermal transfer between the seawater cooling loop 12 and the fresh water cooling loop 14 without departing from the present disclosure.

The seawater cooling loop 12 of the system 10 may include a main pump 16, a secondary pump 18, and a backup pump 20. The pumps 16-20 may be driven by respective variable frequency drives 22, 24, and 26 (hereinafter "VFDs 22, 24, and 26"). The pumps 16-20 may be centrifugal pumps, but it is contemplated that the system 10 may alternatively or additionally include various other types of pumps, including, but not limited to, gear pumps, progressing cavity pumps, or multi-spindle screw pumps, or other positive-displacement pumps or other non-positive displacement pumps.

The VFDs 22-26 may be operatively connected to respective main, secondary, and backup controllers 28, 30, and 32 via communications links 40, 42, and 44. Various sensors and monitoring devices 35, 37, and 39, including, but not limited to, vibration sensors, pressure sensors, bearing temperature sensors, leakage sensors, and other possible sensors, may be operatively mounted to the pumps 16, 18 and 20 and connected to the corresponding controllers 28, 30 and 32 via the communications links 34, 36, and 38. These sensors may be provided for monitoring the health of the pumps 16, 18, and 20 as further described below.

The controllers 28-32 may further be connected to one another by communications link 46. The communications link 46 may be transparent to other networks, providing supervising communication capability. The controllers 28-32 may be configured to control the operation of the VFDs 22-26 (and therefore the operation of the pumps 16-20) to regulate the flow of seawater to the heat exchanger 15 as further described below. The controllers 28-32 may be any suitable types of controllers, including, but not limited to, proportional-integral-derivative (PID) controllers and/or a programmable logic controllers (PLCs). The controllers 28-32 may include respective memory units and processors (not shown) that may be configured to receive and store data provided by various sensors in the cooling system 10, to communicate data between controllers and networks outside of the system 10, and to store and execute software instructions for performing the method steps of the present disclosure as described below.

An operator may establish a plurality of pump parameters at the controller 28, VFD 22, or other user interface. Such pump parameters may include, but are not limited to, a reference speed, a reference efficiency, a reference flow, a reference head, a reference pressure, speed limits, suction pressure limits, discharge pressure limits, bearing temperature limits, and vibration limits. These parameters may be provided by a pump manufacturer (such as in a reference manual) and may be entered into the controller 28, VFD 22, or other user interface by the operator or by external supervising devices via the communications link 46. Alternatively, it is contemplated that the controller 28, VFD 22, or other user interface may be preprogrammed with pump parameters for a plurality of different types of commercially available pumps, and that the operator may simply specify the type of pumps that are currently being used by the system 10 to load a corresponding set of parameters. It is further contemplated that the controller 28 or VFD 22 may be configured to automatically determine the type of pumps that are connected in the system 10 and to load a corresponding set of parameters without any operator input.

An operator may also establish a plurality of system parameters at the controller 28, VFD 22, or other user interface. Such parameters may include, but are not limited to, a fresh water temperature range, a VFD motor speed range, a minimum pressure level, a fresh water flow, a water heat capacity coefficient, a heat exchanger surface area, a heat transfer coefficient, presence of a 3-way valve, and ambient temperature limits.

Pump parameters and system parameters that are established at the controller 28 or VFD 22 may be copied to the other controllers 30 and 32 and/or to the other VFDs 24 and 26, such as via transmission of corresponding data through the communications link 46. Such copying of the parameters may be performed automatically or upon entry of an appropriate command by the operator at the controller 28, VFD 22, or other user interface. The operator is therefore only required to enter the parameters once at a single interface instead of having to enter the parameters at each controller 28-32 and/or VFD 22-26 as in other pump systems.

The communications links 34-46, as well as communications links 81, 104 and 108 described below, are illustrated as being hard wired connections. It will be appreciated, however, that the communications links 34-46, 91, 104 and 108 of the system 10 may be embodied by any of a variety of wireless or hard-wired connections. For example, the communications links 34-46, 91, 104 and 108 may be implemented using Wi-Fi, Bluetooth, PSTN (Public Switched Telephone Network), a satellite network system, a cellular network such as, for example, a GSM (Global System for Mobile Communications) network for SMS and packet voice communication, General Packet Radio Service (GPRS) network for packet data and voice communication, or a wired data network such as, for example, Ethernet/Internet for TCP/IP, VOIP communication, etc.

The seawater cooling loop 12 may include various piping and piping system components ("piping") 50, 52, 54, 56, 58, 60, 62, 64, 66, 68, 69, 70, 109, 110, 111, 112, 113, 114 for drawing water from the sea 72, through the pumps 16-20, and for circulating the seawater through the seawater cooling loop 12, including a seawater side of the heat exchanger 15, as further described below. The piping 50-70 and 109-114, as well as piping 84, 86, 88, 90, 92, 94, 95, 97, 99 and 101 of the fresh water cooling loop 14 and the additional systems 103, 105, and 107 described below, may be any type of rigid or flexible conduits, pipes, tubes, or ducts that are suitable for conveying seawater, and may be arranged in any suitable configuration aboard a vessel or platform as may be appropriate for a particular application.

The seawater cooling loop 12 may further include a discharge valve 89 disposed intermediate the conduits 69 and 70 and connected to the main controller 28 via communications link 91. It is contemplated that the discharge valve 89 may also be connected to the secondary controller 30 and/or the backup controller 32, as these controllers may automatically identify the connected discharge valve 89 and may automatically distribute information pertaining to the connection of the discharge valve 89 to one another via the communications link 46. The discharge valve 89 may be adjustably opened and closed to vary the operational characteristics (e.g., pressure) of the pumps 16-20 as further described below. In one non-limiting exemplary embodiment, the discharge valve 89 is a throttle valve.

The seawater cooling loop 12 may further include flow regulation valves 115, 116, 117, 118 disposed intermediate conduits 66 and 109, 110 and 68, 111 and 112, and 113 and 114, respectively. The flow regulation valves 115-118 may be connected to the main controller 28 via communications link 91 (as shown in FIG. 1) and/or via one or more additional communications links for controlling operation of those valves. It is contemplated that the flow regulation valves 115-118 may also be connected to the secondary controller 30 and/or the backup controller 32, as these controllers may automatically identify the connected discharge valve 89 and may automatically distribute information pertaining to the connection of the discharge valve 89 to one another via the communications link 46. The flow regulation valves 115-118 may be selectively opened and closed to vary the direction in which seawater is circulated through heat exchanger 15. Particularly, during normal operation of the system 10, the flow regulation valves 115, 116 may be open and the flow regulation valves 117, 118 may be closed to circulate seawater through the heat exchanger 15 in a first direction for cooling the fresh water in the fresh water cooling loop 14 as further described below.

As will be appreciated it can be desirable to periodically backflush the heat exchanger 15 to remove organic matter and/or other buildup that can accumulate in the tubes and/or between the plates during extended operation. Thus, as will be described, the disclosed system can be employed to automatically and/or manually configure itself into a back flushing mode. During a back flushing operation, the flow regulation valves 115, 116 may be closed and the flow regulation valves 117, 118 may be opened to circulate seawater through the heat exchanger 15 in a second direction opposite the first direction, thereby back-flushing and cleaning the heat exchanger 15 will be further described below in relation to FIG. 8.

The seawater cooling loop 12 may further include a resistance temperature detector 119 (hereinafter "RTD 119") or other temperature measurement device that is operatively connected to a discharge side of the heat exchanger 15, such as at a position upstream of the discharge valve 89 intermediate the conduits 68 and 69. The RTD 119 may be connected to the main controller 28 via communications link 91 and/or via one or more additional communications links. It is contemplated that the RTD 119 may also be connected to the secondary controller 30 and/or the backup controller 32, as these controllers may automatically identify the connected RTD 119 and may automatically distribute information pertaining to the connection of the RTD 119 to one another via the communications link 46. The RTD 119 may be used to monitor a temperature of the seawater in the seawater cooling loop 12, such as for determining whether the seawater is approaching a temperature at which salt in the seawater may crystalize. If it is determined that the seawater is approaching such a temperature, the main controller 28 may operate one or more of the pumps 16-20 to mitigate salt crystallization as further will be described below in relation to FIG. 7.

The fresh water cooling loop 14 of the system 10 may be a closed fluid loop that includes a fluid pump 80 and various piping and components 84, 86, 88, 90, 92, and 94 for continuously pumping and conveying fresh water through the heat exchanger 15 and the engine 11 for cooling the engine 11 as further described below. The fresh water cooling loop 14 may further include a 3-way valve 102 that is connected to the main controller 28 via communications link 104 for controllably allowing a specified quantity of water in the fresh water cooling loop 14 to bypass the heat exchanger 15 as further described below.

A temperature in the fresh water cooling loop 14 may be measured and monitored by the main controller 28 to facilitate various control operations of the cooling system 10. Such temperature measurement may be performed by a resistance temperature detector 106 (hereinafter "RTD 106") or other temperature measurement device that is operatively connected to the fresh water cooling loop 14. The RTD 106 is shown in FIG. 1 as measuring the temperature of the fresh water cooling loop 14 on the inlet side of the engine 11, but it is contemplated that the RTD 106 may alternatively or additionally measure the temperature of the fresh water cooling loop 14 on the outlet side of the engine 11. The RTD 106 may be connected to the main controller 28 by communications link 108 or, alternatively, may be an integral, onboard component of the main controller 28. It is contemplated that the RTD 106 may also be connected to the secondary controller 30 and/or the backup controller 32, as these controllers may automatically identify the connected RTD 106 and may automatically distribute information pertaining to the connection of the RTD 106 to one another via the communications link 46.

The seawater cooling loop 12 may additionally provide seawater to various other systems of a vessel or platform for facilitating the operation of such systems. For example, seawater from the seawater cooling loop 12 may be provided to one or more of a fire suppression system 103, a ballast control system 105, and/or a seawater steering system 107 on an as-needed basis. Although not shown, other seawater-operated systems that may receive seawater from the seawater cooling loop 12 in a similar manner include, but are not limited to, sewage blowdown, deck washing, air conditioning, and fresh water generation.

In the exemplary system 10 shown in FIG. 1, seawater may be provided to the systems 103-107 via piping 95, 97, 99, and 101, which may be connected to the seawater cooling loop 12 at piping 66, for example. The piping 95-101 may be provided with various manually or automatically controlled valves (not shown) for directing the flow of seawater into the systems 103-107 in a desired manner. Of course, it will be appreciated that if seawater is supplied to the systems 103-107, the flow of seawater through the heat exchanger 15 will be reduced, which may cause the temperature in the fresh water cooling loop 14 to rise unless the operation of the pumps 16-20 is modified. The pumps 16-20 may therefore be controlled in manner that compensates for the use of seawater by the systems 103-107 as will described in greater detail below.

It is contemplated that the system 10 may monitor the total amount of time that each of the pumps 16-20 has been operating and may reallocate the operation of the pumps 16-20 in a manner that equalizes, or attempts to equalize, the operating times of the pumps 16-20. For example, if the main pump 16 has logged 100 hours of operation, the secondary pump 18 has logged 50 hours of operation, and the backup pump has logged only 5 hours of operation, the system 10 may reassign the primary pump 16 to operate as a backup pump and may reassign the backup pump 20 to operate as a primary pump. The pumps 18 and 20 may thereby continue to accumulate significant operating time while the pump 16 remains substantially idle. By equalizing the operating times of the pumps 16-20 thusly, the pumps 16-20 may be caused to wear at a substantially uniform rate and may therefore be serviced or replaced according to a uniform schedule.

The above-described equalization procedure may be performed automatically, such as accordingly to a predefined schedule. For example, when one of the pumps 16-20 accumulates a predefined (e.g., operator-defined) amount of operating time since a last reallocation, the equalization procedure may be performed and the roles of the pumps 16-20 may be reassigned as necessary to equalize usage. The equalization procedure may also be initiated manually at the discretion of an operator, such as through the entry of an appropriate command at an operator interface.

The system 10 may be operated in a variety of different operator-selectable modes, such as may be selected via an operator interface (not shown), wherein each operating mode may dictate a particular minimum system pressure that will be maintained by the system 10. For example, a first operating mode may be a "no threshold" or similarly designated mode which, if selected, will cause the system 10 to operate the pumps 16-20 without regard to any predetermined or specified minimum system pressure. That is, the system 10 will operate the pumps 16-20 based solely on the cooling demands of the engine 11. For example, if seawater is taken from the seawater cooling loop 12 by any of the seawater-operated systems (e.g., the ballast control system 105), the flow of seawater through the heat exchanger 15 will decrease, thereby reducing the amount of cooling in the fresh water cooling loop 14. The temperature of the water in the fresh water cooling loop 14 may therefore increase. As described above, the main controller 28 may then determine that the monitored temperature of the fresh water exceeds, or is about to exceed, a predefined temperature level, and the main controller 28 may respond by increasing the speed of the VFD 22 and may issue a command to the secondary controller 30 to increase the speed of the VFD 24 to the speed of the VFD 22, for example. The corresponding main and/or secondary pumps 16 and 18 are thereby driven faster, and the flow of seawater through the seawater cooling loop 12 is increased. Greater cooling is thereby provided at the heat exchanger 15, and the temperature in the fresh water cooling loop 14 is resultantly decreased. Thus, a sufficient amount of seawater may be supplied for cooling the engine 11 and for operating a ship's seawater-operated systems in a purely "on-demand" fashion by driving the pumps 16-20 only as necessary to meet contemporaneous needs, thereby optimizing the efficiency of the system 10. This is to be contrasted with conventional seawater cooling systems, in which a minimum system pressure (i.e., a minimum seawater pressure that has been determined to be necessary for operating some or all of a ship's seawater-operated systems) is constantly maintained regardless of contemporaneous system needs.

A second selectable operating mode may be a "minimum threshold" or similarly designated mode which, if selected, may allow an operator to manually enter a minimum threshold value and will thereafter cause the system 10 to operate the pumps 16-20 in a manner that will keep a ship's system pressure above the manually specified threshold value. The minimum threshold value may be a value that is below a minimum system pressure (described above), but that provides some constantly maintained amount of seawater pressure in a ship's system. The ship's system pressure may be monitored by sensors that are integral with the ship and that are independent of the system 10, and may be communicated to the system 10 via a communications link, such as the communications link 46. The "minimum threshold" mode may be suitable for situations in which a system operator is not comfortable with operating the system 10 in a purely on-demand manner (as in the "no threshold" mode described above) but still wants to achieve a greater level of system efficiency relative to traditional seawater cooling systems in which a minimum system pressure in constantly maintained. After a system operator becomes comfortable with the on-demand capability of the system 10, the operator may lower or completely remove the minimum threshold value. This flexibility provides system operators with options to fit their application needs.

A third selectable operating mode may be a "minimum system pressure" or similarly designated mode which, if selected, will cause the system 10 to operate the pumps 16-20 in manner that will keep a ship's system pressure above the ship's predetermined (e.g., pre-calculated) minimum system pressure. As described above, the minimum system pressure may be a minimum seawater pressure that has been determined to be necessary for operating some or all of a ship's seawater-operated systems. Again, a ship's system pressure may be monitored by sensors that are integral with the ship and that are independent of the system 10, and may be communicated to the system 10 via a communications link. The "minimum system pressure" mode may be suitable for situations in which a system operator is not comfortable with operating the system 10 in a purely on-demand manner (as in the "no threshold" mode described above) or with maintaining a system pressure that is less than the minimum system pressure (as in the "minimum threshold" mode described above).

It will be appreciated that the above-described operating modes provide the system 10 with the flexibility to suit the preferences of various system operators without requiring any reconfiguration of system components prior to installation. Additionally, if the preferences of an operator change over time, such as if an operator is initially hesitant to operate the system 10 at less than a minimum system pressure, the operator may seamlessly switch between operating modes and graduate to purely on-demand operation as his/her comfort level increases.

Figure 2:
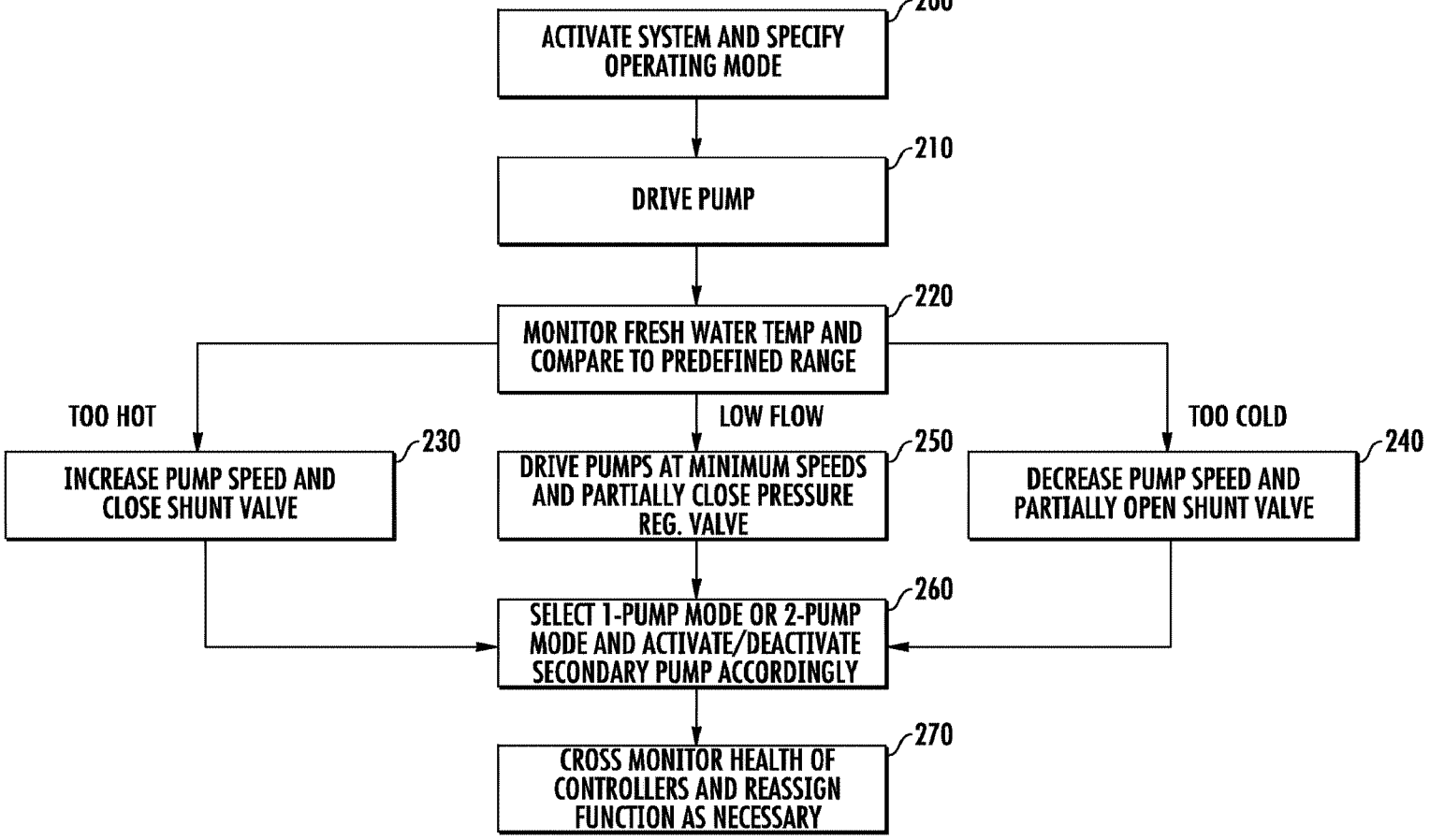
FIG. 2 is a flow diagram illustrating an exemplary method for operating the intelligent seawater cooling system shown in FIG. 1 in accordance with the present disclosure.

Referring to FIG. 2, a flow diagram illustrating a general exemplary method for operating the system 10 in accordance with the present disclosure is shown. The method will be described in conjunction with the schematic representation of the system 10 shown in FIG. 1. Unless otherwise specified, the described method may be performed wholly or in part by the controllers 28-32, such as through the execution of various software algorithms by the processors thereof.

At step 200, the system 10 may be activated, such as by an operator making an appropriate selection in an operator interface (not shown) of the system 10. Upon such activation, the operator may be prompted to select an operating mode which may dictate a minimum system pressure that will be maintained by the system 10. For example, the operator may be prompted to select one of the described above "no threshold," "minimum threshold," or "minimum system pressure" operating modes.

Once the system 10 has been activated and an operating mode has been specified, the main and secondary controllers 28 and 30 may, at step 210 of the exemplary method, command the VFDs 22 and 24 to begin driving at least one of the pumps 16 and 18. The pumps 16 and 18 may thus begin pumping seawater from the sea 72, through the piping 52 and 54, through the pumps 16 and 18, through the piping 58-66, through the heat exchanger 15, and finally through the piping 68 and 70 and back to the sea 72. As the seawater flows through the heat exchanger 15, it may cool the fresh water in the fresh water cooling loop 14 that also flows through the heat exchanger 15. The cooled fresh water thereafter flows through and cools the engine 11.

At step 220 of the exemplary method, the main controller 28 may monitor the temperature of the fresh water in the fresh water cooling loop 14 via the RTD 106. The main controller 28 may thereby determine whether the fresh water is at a desired temperature for providing the engine 11 with appropriate cooling, such as by comparing the monitored temperature to a predefined temperature level and a predefined temperature range. For example, the desired temperature level of the fresh water at the discharge of the heat exchanger may be 35 degrees Celsius, and the predefined temperature range may be +/−3 degrees Celsius.

If the main controller 28 determines at step 220 that the monitored temperature of the fresh water exceeds, or is about to exceed, a predefined temperature level, the main controller 28 may, at step 230 of the exemplary method, increase the speed of the VFD 22 and may issue a command to the secondary controller 30 to increase the speed of the VFD 24 to the speed of the VFD 22, for example. The corresponding main and/or secondary pumps 16 and 18 are thereby driven faster, and the flow of seawater through the seawater cooling loop 12 is increased. Greater cooling is thereby provided at the heat exchanger 15, and the temperature in the fresh water cooling loop 14 is resultantly decreased.

Conversely, if the main controller 28 determines at step 220 that the monitored temperature of the fresh water is below, or is about to fall below, a predefined temperature level, the main controller 28 may, at step 240 of the exemplary method, decrease the speed of the VFD 22 and may issue a command to the secondary controller 30 to decrease the speed of the VFD 24 to the speed of the VFD 22, for example. The corresponding main and secondary pumps 16 and 18 are thereby driven more slowly, and the flow of seawater through the seawater cooling loop 12 is decreased. Less cooling is thereby provided at the heat exchanger 15 and the temperature in the fresh water cooling loop 14 is resultantly increased. Under certain circumstances, such as if the fresh water temperature is still too low (e.g., below the desired temperature level or below the lower value of the predefined temperature range) and the pump speeds cannot be lowered further due to the requirement of maintaining minimum system pressure and/or minimum pump speed, the main controller 28 may additionally command the 3-way valve 102 to adjust its position, thereby diverting some or all of the fresh water in the fresh water cooling loop 14 to bypass the heat exchanger 15 in order to further reduce the cooling of the fresh water.

Regardless of how little cooling the engine 11 may require, if the "minimum threshold" mode or the "minimum system pressure" mode were selected in step 200 above, the pumps 16 and 18 will not be driven at speeds that would allow the monitored ship's system pressure to fall below the predetermined minimum system pressure or the specified minimum threshold value (described above), respectively. Some minimum level of seawater pressure may therefore be maintained in the ship's system at all times for supplying seawater to the seawater-operated systems.

If the "no threshold" mode was selected in step 200, the system 10 will not operate according to any predetermined or specified minimum system pressure, but will instead operate solely in response to the cooling requirements of the engine 11 as described above to ensure that a sufficient amount of seawater is pumped in an on-demand manner to provide engine cooling and to supply seawater-operated systems.

Under certain circumstances, such as if the system 10 is operating in particularly cold waters and/or if the engine 11 is idling, it may be desirable to reduce the flow of seawater in the seawater cooling loop 12 to a rate below what may be achieved through the reduction of the pump speeds while maintaining stable operation of the pumps 16 and 18. That is, regardless of how little flow is required in the seawater cooling loop 12, it may be necessary to run the pumps 16 and 18 at a minimum safe operating speed to avoid cavitation or damage to the pumps 16 and 18, for example. If the main controller 28 determines that such a low flow rate of seawater is desirable, the main controller 28 may, at step 250, decrease the speed of the VFD 22 to drive the main pump 16 at or near a minimum safe operating speed, may command the secondary controller to decrease the speed of the VFD 24 to drive the secondary pump 18 at or near a minimum safe operating speed (or to shut down), and may further command the discharge valve 89 to partially close in order to maintain a required minimum system discharging pressure. By partially closing the discharge valve 89 thusly, the flow rate in the seawater cooling loop 12 may be restricted/reduced without further reducing the operational speeds of the pumps 16 and 18, and the minimum required system pressure can be maintained. The pumps 16 and 18 may thereby be operated above their minimum safe operating speeds while achieving a desired low flow rate in the seawater cooling loop 12. The discharge valve 89 may be controlled in a similar manner for keeping a ship's system pressure above a predetermined or specified system pressure (i.e., if the "minimum system pressure" mode or the "specified pressure" mode were selected in step 200).

Figure 5:
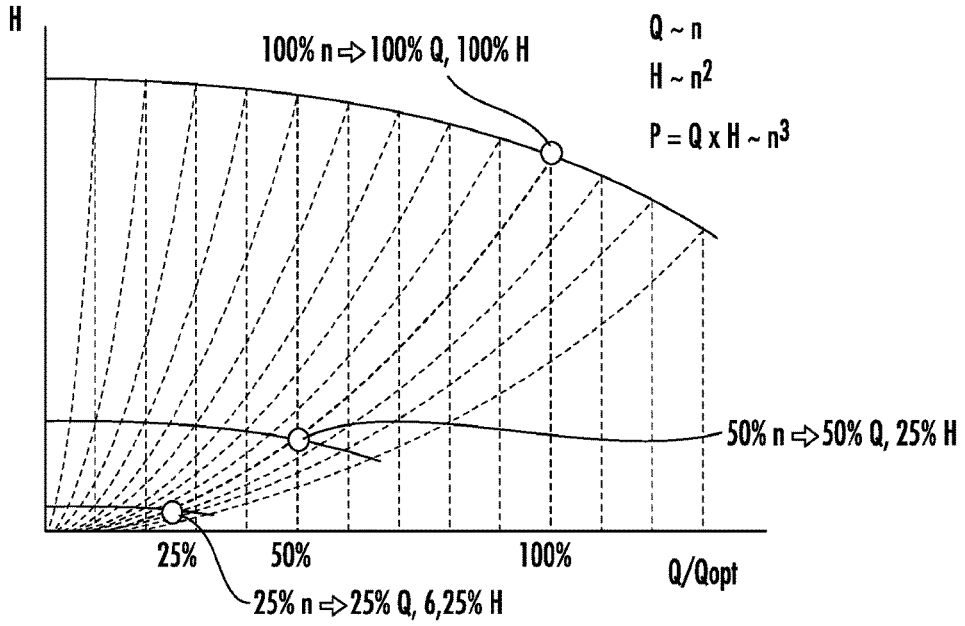
FIG. 5 is a graph illustrating energy savings as a result of reductions in pump speeds.

By continuously monitoring the temperature in the fresh water cooling loop 14 and adjusting the pump speeds and flow rate in the seawater cooling loop 12 in the manner described above, the pumps 16 and 18 may be driven only as fast as is necessary to provide a requisite amount of cooling at the heat exchanger 15 and/or to maintain a predetermined or specified minimum system pressure. The system 10 may therefore be operated much more efficiently and may provide significant fuel savings relative to traditional seawater cooling systems in which seawater pumps are driven at a constant speed regardless of temperature variations. Such improved efficiency is illustrated in the graph shown in FIG. 5. As will be appreciated by those of ordinary skill in the art, pump power "P" is proportional to the cube of pump speed "n," while flowrate "Q" is proportional to pump speed "n." Thus, when the disclosed system 10 is operated at a lower Q because of lower cooling demand from the engine, in lieu of running the pumps at maximum speed and simply shunting excess flow overboard or through a recirculation loop, substantial power savings can be achieved. For example, if Q=50% of the rated seawater flow Qopt, then the pumps 16, 18 need only be operated at 50% of their rated speed to provide 50% of Qopt. This reduction in speed results in a power "P" reduction of 87.5%, as compared to prior systems in which the pumps 16, 18 are operated at a constant maximum speed (or rated speed).

At step 260 of the exemplary method, the main controller 28 may determine whether the system 10 should be operated in a 1-pump mode or a 2-pump mode in order to achieve a desired efficiency and more energy savings. That is, it may be more efficient in some situations (e.g., if minimal cooling is required) to drive only one of the pumps 16 or 18 and not the other. Alternatively, it may be more efficient and/or necessary to drive both of the pumps 16 and 18 at a low speed. The main controller 28 may make such a determination by comparing the operating speeds of the pumps 16 and 18 to predefined "switch points." "Switch points" is determined by the ratio of Q/Qopt of either 1-pump or 2-pump operation, which can yield more efficient system. For example, if the system 10 is operating in 2-pump mode and both of the pumps 16 and 18 are being driven at less than a predetermined efficiency point, the main controller 28 may deactivate the secondary pump 18 and run only the main pump 16. While 1-pump is running, the efficiency Q/Qopt will increase, resulting a more efficient system over 2-pump operation. Conversely, if the system 10 is operating in 1-pump operation mode (e.g., running only the main pump 16) and the main pump 16 is being driven at greater than a predetermined efficiency point, the main controller 28 may activate the secondary pump 18.

Figure 6:
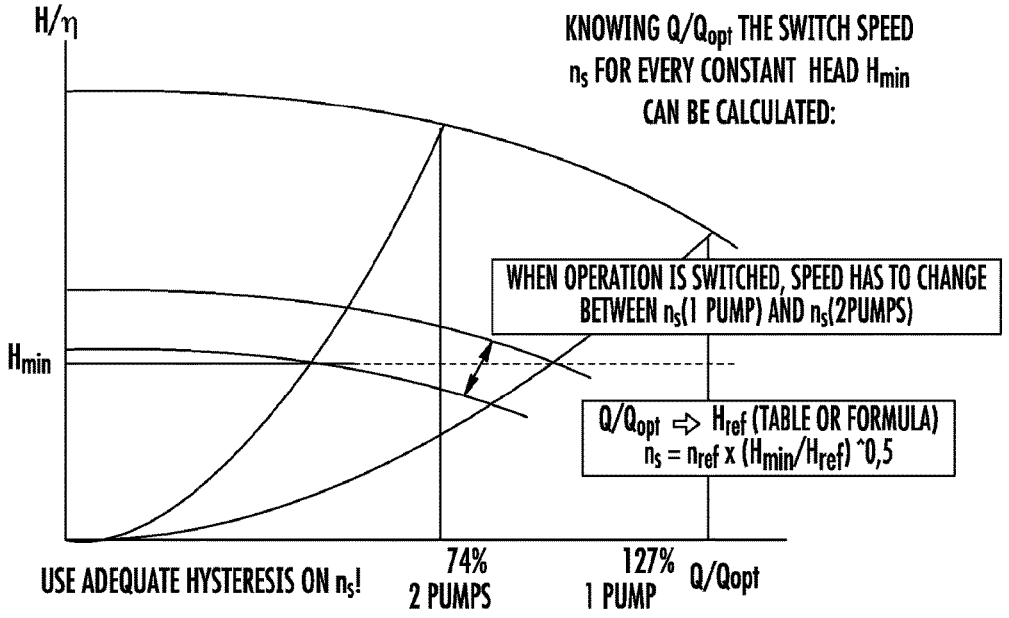
FIG. 6 is a graph illustrating exemplary means for determining whether to operate the system of the present disclosure with 1 pump or 2 pumps.

As shown in FIG. 6, The switch points (between one and two pump operation) may be determined based on the actual flow rate "Q" in the system 10 compared to optimal flow range "Qopt." According to the exemplary curve, when Q/Qopt exceeds 127% under single pump operation, the system can switch to two pump operation to operate most efficiently. Likewise, when Q/Qopt falls below 74% under two pump operation, the system can switch to single pump operation. At the same time, the discharging valve is controlled so that the required minimum system discharging pressure is maintained at all times.

At step 270 of the exemplary method, the main, secondary, and backup controllers 28, 30, and 32 may periodically transmit data packets to one another, such as via communications link 46. Such data packets may include information relating to the critical operational status, or "health," of each of the controllers 28-32 including their respective pumps 16-20 and VFDs 22-26. If it is determined that one of the controllers 28-32 or its respective pump has ceased to operate properly, or is trending in a direction that would indicate a near or far term malfunction, or if its communications link has malfunctioned or is otherwise inactive, the duties of that controller may be reassigned to another one of the controllers. For example, if it is determined that the secondary controller 30 has ceased to operate properly, the duties of the secondary controller 30 may be reassigned to the backup controller 32. Alternatively, if it is determined that the main controller 28 has ceased to operate properly, the duties of the main controller 28 may be reassigned to the secondary controller 30 and the duties of the secondary controller 30 may be subsequently reassigned to the backup controller 32. The system 10 is thereby provided with a level of automatic redundancy that allows to the system 10 carry on with normal operation even after the occurrence of component failures. If the ceased or questionable controller is repaired and/or restored to operational conditions, and is brought back to the operation, the information will be broadcast over the communication link to other controllers, the backup controller will automatically stop its operation of its pump, and will be in stand-by mode for providing future needs for its backup role.

Figure 3:
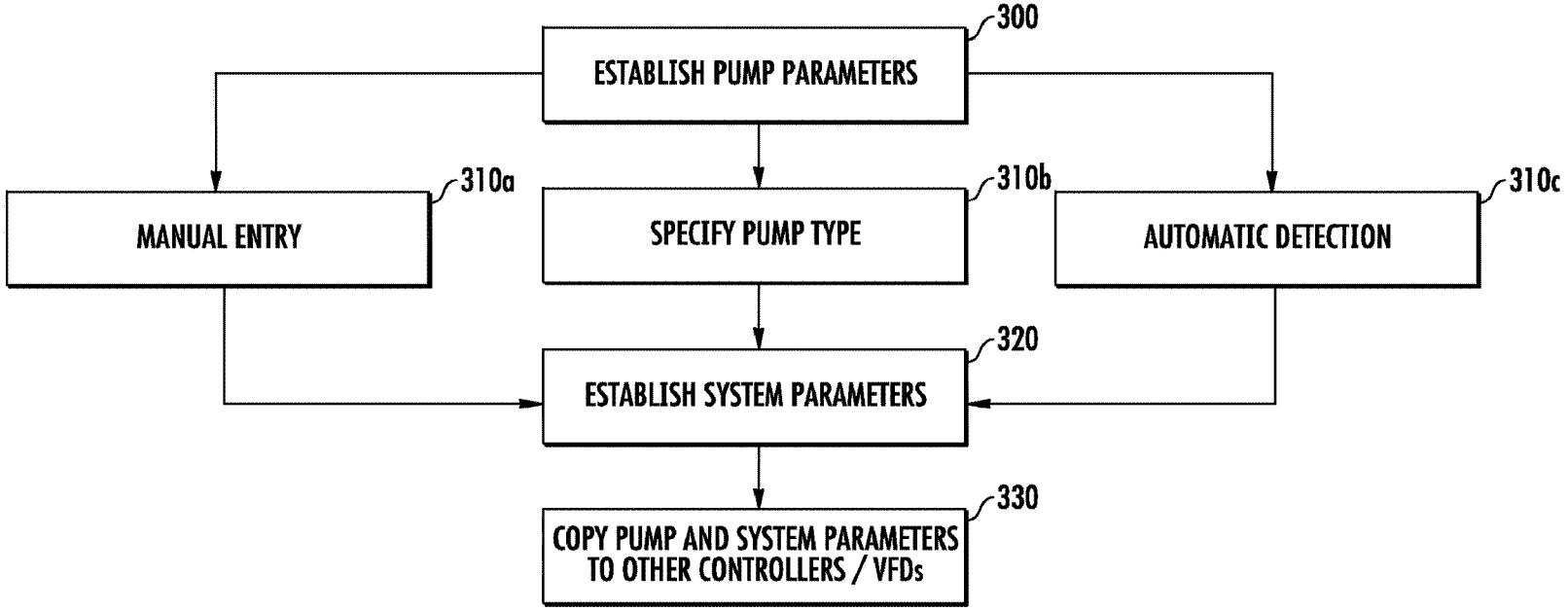
FIG. 3 is a flow diagram illustrating an exemplary method for establishing parameters in the intelligent seawater cooling system shown in FIG. 1 in accordance with the present disclosure.

Referring to FIG. 3, a flow diagram illustrating an exemplary method for inputting operating parameters into the system 10 in accordance with the present disclosure is shown.

At a first step 300 of the exemplary method, an operator may establish a plurality of pump parameters at the controller 28, VFD 22, or other user interface. As described above, such pump parameters may include, but are not limited to, a reference speed, a reference efficiency, a reference flow, a reference head, a reference pressure, speed limits, suction pressure limits, discharge pressure limits, bearing temperature limits, and vibration limits. These parameters may be provided by a pump manufacturer (such as in a reference manual) and may, at step **310*a*, be manually entered into the controller 28, VFD 22, or other user interface by the operator or by external supervising devices via the communications link 46. Alternatively, it is contemplated that the controller 28, VFD 22, or other user interface may be preprogrammed with pump parameters for a plurality of different types of commercially available pumps as described above, and that the operator may, at step 310*b*, simply specify the type of pumps that are currently being used by the system 10 to load a corresponding set of parameters. In another contemplated embodiment, the controller 28 or VFD 22 may be configured to automatically determine the type of pumps that are connected in the system 10 and to automatically load a corresponding set of parameters without any operator input as indicated at step 310***c*.

At step 320 of the exemplary method, the operator may establish a plurality of system parameters at the controller 28, VFD 22, or other user interface. Such parameters may include, but are not limited to, a fresh water temperature range, a VFD motor speed range, a minimum pressure level, a fresh water flow, a water heat capacity coefficient, a heat exchanger surface area, a heat transfer coefficient, presence of a 3-way valve, and ambient temperature limits.

At step 330 of the exemplary method, the pump parameters and system parameters that were established in the preceding steps may be copied to the other controllers 30 and 32 and/or to the other VFDs 24 and 26, such as via transmission of corresponding data through the communications link 46. Such copying of the parameters may be performed automatically or upon entry of an appropriate command by the operator at the controller 28, VFD 22, or other user interface. The operator is therefore only required to enter the parameters once at a single interface instead of having to enter the parameters at each controller 28-32 and/or VFD 22-26 as in other pump systems.

Figure 4:
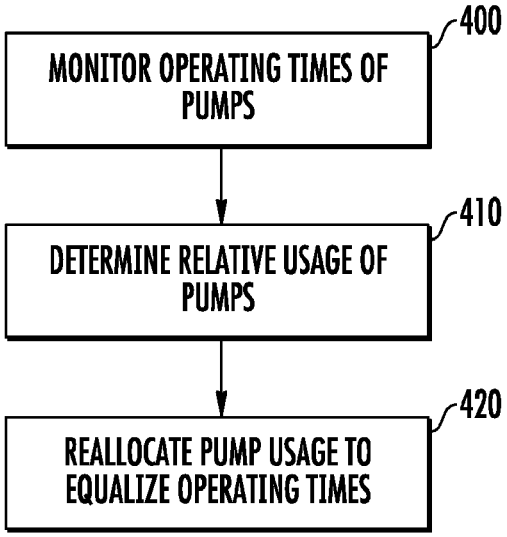
FIG. 4 is a flow diagram illustrating an exemplary method for equalizing pump usage in the intelligent seawater cooling system shown in FIG. 1 in accordance with the present disclosure.

Referring to FIG. 4, a flow diagram illustrating an exemplary method for equalizing usage of the pumps 16-20 of the system 10 in accordance with the present disclosure is shown.

At step 400 of the exemplary method, the system 10 may monitor the total amount of time that each of the pumps 16-20 has been operating. At step 410, the system 10 may determine whether one of the pumps 16-20 has been operating for a specified amount of time longer than at least one of the other pumps 16-20. At step 420, the system 10 may reallocate the operation of the pumps 16-20 in a manner that equalizes, or attempts to equalize, the operating times of the pumps 16-20. For example, if the main pump 16 has logged 100 hours of operation, the secondary pump 18 has logged 50 hours of operation, and the backup pump has logged only 5 hours of operation, the system 10 may reassign the primary pump 16 to operate as a backup pump and may reassign the backup pump 20 to operate as a primary pump. The pumps 16 and 20 may thereby continue to accumulate significant operating time while the pump 16 remains substantially idle. By equalizing the operating times of the pumps 16-20 thusly, the pumps 16-20 may be caused to wear at a substantially uniform rate and may therefore be serviced or replaced according to a uniform schedule.

The above-described equalization procedure may be performed automatically, such as accordingly to a predefined schedule. For example, when one of the pumps 16-20 accumulates a predefined (e.g., operator-defined) amount of operating time since a last reallocation, the equalization procedure may be performed and the roles of the pumps 16-20 may be reassigned as necessary to equalize usage. The equalization procedure may also be initiated manually at the discretion of an operator, such as through the entry of an appropriate command at an operator interface.

Figure 7:
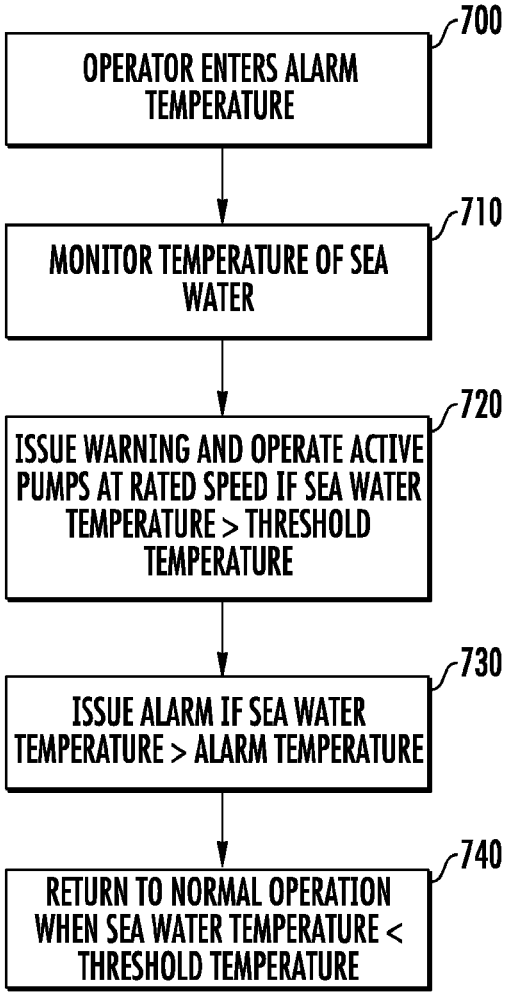
FIG. 7 is a flow diagram illustrating an exemplary method for mitigating salt crystallization in a seawater cooling loop of the intelligent seawater cooling system shown in FIG. 1 in accordance with the present disclosure.

Referring now to FIG. 7, a method will be described for mitigating the formation of salt crystals within the cooling system. As will be appreciated, when seawater temperatures within the heat exchanger 15 exceed a threshold temperature, salt can crystallize within the cooling system. Substantial accumulation of such salt crystals, as can occur over time, can result in undesirable clogging of the heat exchanger, as well as the system piping and components.

In general, a temperature sensor (such as RTD 119, see FIG. 1) can be mounted at the seawater discharge of the heat exchanger 15 to enable seawater temperature to be monitored by one of the networked controllers 28, 30, 32. In some embodiments this information can be shared among the controllers in the network. An alarm setpoint can be provided by a system operator, such that if seawater temperature rises by a prescribed amount (e.g., 5 degrees Celsius) below the alarm setpoint, a warning will be issued and all operating pumps 16, 18, 20 in the system will operate at rated speed, to reduce the seawater temperature to prevent salt crystallization. In some embodiments this feature will override the normal fresh water temperature regulation scheme.

If seawater temperature rises above the alarm setpoint, an alarm will also be issued. Once the system enters into this "seawater temperature reduction mode," and the seawater temperature thereafter drops below the warning level (e.g., 5 degrees C. below the alarm setpoint), the system will go back to the "normal" operation in which fresh water temperature regulation and minimum system pressure regulation determine the operational speed of the pumps 16, 18, 20.

The described "seawater temperature reduction mode" facilitates automatic prevention of sea salt crystallization and accumulation in the cooling system components. It enables a single temperature input to be monitored and shared with the networked pumps 16, 28, 20. Actions of the pumps are not individualized, but instead they react as a system.

FIG. 7 is a flow diagram illustrating a non-limiting exemplary method for monitoring seawater temperature and preventing salt crystallization in the seawater cooling loop 12 of the system 10 is shown.

At step 700, an operator may enter an alarm temperature at the controller 28, VFD 22, or other user interface. The alarm temperature may be a temperature at which salt may crystalize in the seawater cooling loop 12 and may resultantly clog the system 10.

At step 710, the system 10 may monitor a temperature of the seawater in the seawater cooling loop 12. For example, the main controller 28 may receive a temperature measurement from the RTD 119. If it is determined that the measured seawater temperature exceeds some predetermined threshold temperature that is below the alarm temperature (e.g., 5 degrees Celsius below the alarm temperature) but does not exceed that alarm temperature, the system 10 may, at step 720, issue a warning to notify the system operator(s) of such condition, and may further command any active pumps 16-20 to operate at their maximum rated speed, regardless of the cooling demands of the engine 11, in order to lower the temperature of the seawater in the seawater cooling loop 12 and thereby prevent or mitigate salt crystallization and clogging. Additionally, if it is determined that the measured seawater temperature exceeds the alarm temperature, the system 10 may, at step 730, issue an alarm to the system operator(s), at which point more drastic measures may be taken to prevent, mitigate, and or remedy salt crystallization and clogging within the system 10.

It will be appreciated that, as a result of operating the active pumps 16-20 at their rated speed in order to cool the seawater to a temperature that prevents or mitigates salt crystallization, the fresh water in the fresh water cooling loop 14 may be cooled to temperatures that are below what is necessary for maintaining the engine 11 at a desired, safe operating temperature. In such a case, the main controller 28 may additionally command the 3-way valve 102 to adjust its position to divert some or all of the fresh water in the fresh water cooling loop 14 to bypass the heat exchanger 15 in order to further reduce the cooling of the fresh water.

After the temperature of the seawater in the seawater cooling loop 12 drops below the threshold temperature, the system 10 may, at step 740, return to normal operation, wherein the pumps 16-20 are driven partly or entirely in response to the cooling demands of the engine 11 in the manner previously described. The exemplary method set forth in FIG. 7 thus facilitates automatic mitigation or prevention of salt crystallization and resultant clogging within the system 10 using only a single temperature input in the seawater cooling loop 12.

Figure 8:
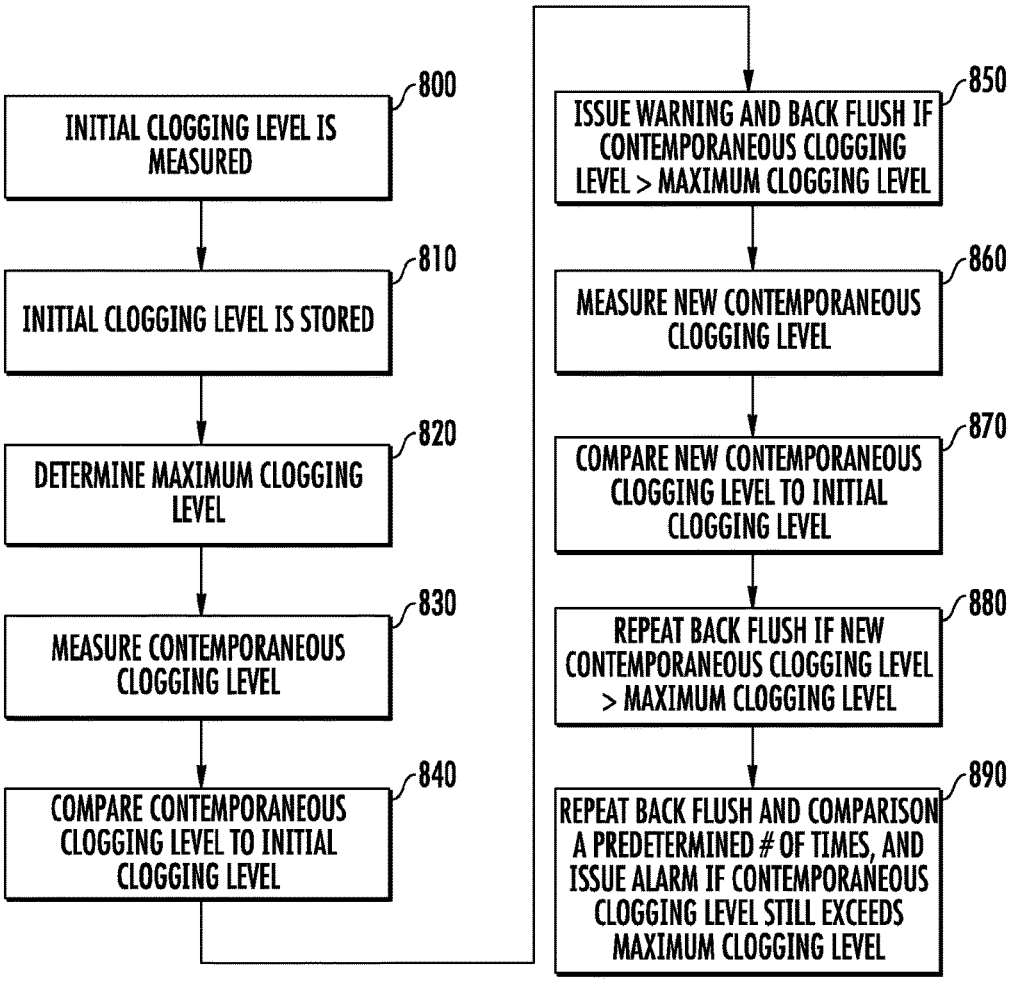
FIG. 8 is a flow diagram illustrating an exemplary method for monitoring and reducing clogging in a seawater cooling loop of the intelligent seawater cooling system shown in FIG. 1 in accordance with the present disclosure.

Referring now to FIG. 8, a method will be described for mitigating clogging of the heat exchanger 15 and related components. In general this is accomplished by identifying an initial system resistance of the cooling system. For example, after a new installation or after a major system maintenance, an operator can initiate an initial set-up operation on the main controller 28. The main controller 28 may then broadcast this command to the controllers 30 and 32 over the communication link 46. All of the pumps 16-20 in the network may then operate at a predefined speed (e.g., at their rated speeds), for a predefined amount of time. The system pressure will then be recorded into the controllers 28, 30, and 32.

Thereafter, a clogging resistance ("clogging level") of the cooling system can be periodically monitored, either through the use of a user configurable time schedule, or by on-demand manual operation. During such monitoring, all of the pumps in the network may be operated at the same speeds as they were during the initial set-up operation (described above) for a predefined amount of time, and the system pressure may be recorded into the controllers 28, 30 and 32. The recorded system pressure may then be compared with the initial system resistance level recorded during the initial set-up operation. A warning/alarm can activate if the system pressure exceeds the cooler clogging warning/alarm levels, to thereby remind the user to clean the cooling system using an automatic back flushing process, or by on-demand manual back flushing.

It is contemplated that a measured initial clogging level may be manually modified by an operator within a certain amount of time after the above-described set-up operation, such as may be desirable for various reasons. For example, it may be desirable to manually modify the clogging level if the conditions of various valves in the system change over time, or if certain loads in the system were not present or were not considered during the initial set-up operation.

In some embodiments, when the current system clogging level reaches or exceeds the warning or alarm clogging level, the system can automatically begin a predetermined back flushing operation by opening/closing the appropriate valves to direct flow through the heat exchangers 15 in a reverse direction (as compared to normal operational cooling flow) to flush the system. This back flushing operation can, in some embodiments, be performed for a predetermined amount of time. Alternatively, it can be performed by a manually selected amount of time.

After the back flushing operation is completed, the clogging supervision operation can be performed again to confirm that the current clogging level of the system is at a desired level below the warning/alarm levels. If the current clogging level is not reduced by a sufficient amount after the first trial of back flushing, one or several more back flushing operations can be performed to reduce the current clogging level to a desired value. This function can be performed manually or automatically. After several trials of back flushing operations, if the current logging level is still higher than a desired value, a final alarm can be activated to alert the user that cleaning of the cooling system is required.

The disclosed arrangement provides fully automatic supervision of the clogging level of the cooling system. With the integration of back flushing operation, cooling system cleaning maintenance can be reduced to a minimum (i.e., to when the cooling system really needs the user's attention. This is a benefit compared to prior systems in which back flushing operations are automatically performed on a periodic basis and/or when the vessel is in port, which can result in either unnecessary cleaning or in undesirably delayed cleaning.

FIG. 8 is a flow diagram illustrating an exemplary method for monitoring a cooler clogging level of the system 10 is shown. The method may be employed to determine the degree to which the seawater cooling loop 12 of the system 10 has become clogged (e.g., by salt, debris, biological organisms, etc.) relative to a normal operating level. The measured level of clogging may then be used to determine whether manual and/or automated steps should be taken to mitigate or remedy the clogging.

At step 800, an initial resistance level, or "initial clogging level," of the system 10 may be determined, such as by running all of the pumps 16-20 in the system 10 at their rated speed and measuring the system pressure in the seawater cooling loop 12 with the system pressure sensor. This measurement may be performed as part of an initial setup of the system 10, such as when the system 10 is installed or shortly thereafter. At step 810 the measured initial clogging level may be stored in memory, such as by the main controller 28, secondary control 30, and backup controller 32. The initial clogging level may provide a relative baseline against which future measurements of the clogging level of the system 10 may be compared.

At step 820 the main controller 28 may use the initial clogging level to determine a maximum clogging level. The maximum clogging level may simply be a pressure value that is greater than the pressure value of the initial clogging level by some predetermined amount. Alternatively, it is completed that an operator may manually enter a maximum clogging level. In either case, the maximum clogging level may be stored in memory.

At step 830 a clogging level test may be performed to determine a contemporaneous clogging level of the system 10 at some time after the initial clogging level of the system 10 was measured. The clogging level test may include running all of the pumps 16-20 in the system 10 at their rated speed and measuring a fluid pressure in the seawater cooling loop 12 in substantially that same manner as when the initial clogging level was determined. The clogging level test may be performed automatically, such as accordingly to a predefined schedule (e.g., every week, every month, etc.). Alternatively, the clogging level test may be initiated manually at the discretion of an operator, such as through the entry of an appropriate command at an operator interface.

At step 840 the contemporaneous clogging level may be compared to the maximum clogging level, such as by the main controller 28. If it is determined that the contemporaneous clogging level exceeds the maximum clogging level, the system 10 may, at step 850, issue a warning to notify the system operator(s) of such condition and may further automatically initiate a back flushing operation (described above), whereby the flow regulation valves 115,116 of the seawater cooling loop 12 may be closed and the flow regulation valves 117,118 may be opened to reverse the flow of seawater through the heat exchanger 15. The back flushing may reduce or eliminate the clogging in the system 10.

After the back flushing operation the system 10 may, at step 860 repeat the clogging level test to determine a new contemporaneous clogging level. At step 870, the new contemporaneous clogging level may be compared to the maximum clogging level. If it is determined that the contemporaneous clogging level still exceeds the maximum clogging level, the system 10 may, at step 880, repeat the back flushing procedure. This cycle of testing and back flushing may be repeated a predetermined number of times, and if the contemporaneous clogging level still exceeds the maximum clogging level the system may, at step 890, issue an alarm to the operator(s) of the system 10 indicating that the system 10 should be manually cleaned or that other measures should be taken to reduce the clogging.

As will be appreciated, the exemplary method facilitates automatic monitoring and mitigation of clogging in the system 10, thereby reducing the amount of manual monitoring and intervention that is necessary to operate and maintain the system 10.

Figure 9:
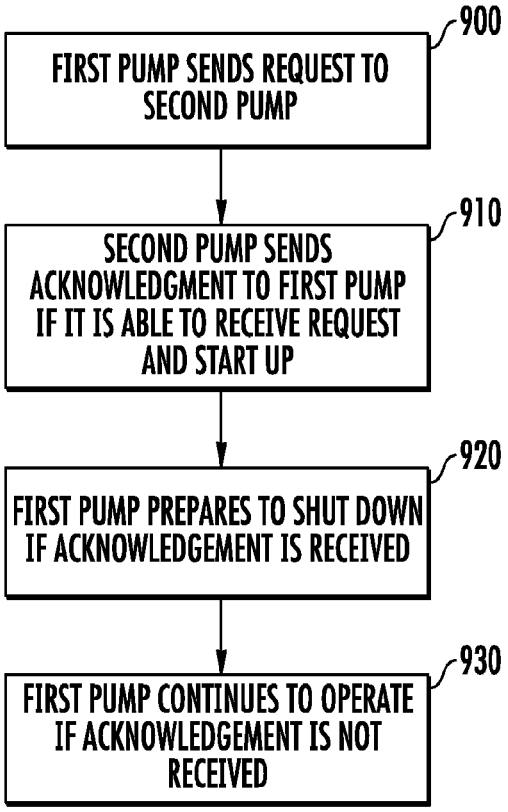
FIG. 9 is a flow diagram illustrating an exemplary method for overlapping the operation of a first pump and a second pump in the intelligent seawater cooling system shown in FIG. 1 in accordance with the present disclosure.

Referring now to FIG. 9, a method will be described for adjustable pump switching overlapping operation of the pumps 16, 18, 20 will be described. When the system switches from one pump to another (either during scheduled switchover, alarms, or cascading), pressure may fluctuate, mostly reduced, due to a time gap between the switching. This can cause the related pumps cease operation momentarily, eventually triggering a system pressure low alarm.

To minimize or eliminate such alarm, during the operation, if one of the operating pumps 16, 28, 20 must be shut down (e.g., due to various system normal operations, or shut-down alarms), that pump will send out a request to the backup pump. When the backup pump receives the request to join into the system operation, the backup pump will start running. At same time, if the backup pump starts running successfully, the backup pump will send an acknowledgement "ack" back to the originator pump. Once the originator pump receives the "ack" from the backup pump, the originator pump can prepare to shut itself down.

This manner in which the originator pump disconnects itself from operation can be a user configurable time delay, or it can be a controlled ramp-down along with a controlled ramp-up of the backup pump, to provide maximum stability of system pressure, and/or to maintain stability of flow.

In some embodiments, if the originator pump does not receive an "ack" from the backup pump (e.g., due to the loss of communication on the communications link 46), the originator pump may continue to operate if it is not under critical shut-down alarms. If the communications link 46 is in good condition, the originator controller will get an "ack" from the backup controller, either indicating it has successfully joined the operation, or that it cannot join the operation due to its own shut-down situations. Under either circumstance, the originator pump will shut-down accordingly.

The disclosed arrangement enables the originating pump and the backup pump to handshake with each other to coordinate the pump switching operation, to ensure the proper operation of the cooling pumps and to ensure proper flow is maintained within the system. Pump switching operations can be configured for optimizing pressure stability or flow stability without any gap during switching. Information can be shared within the networked pumps, and pump actions are not individual, but react as a whole system;

Referring to FIG. 9, a flow diagram illustrating an exemplary method for overlapping the operation of the pumps 16-20 in the system 10 is shown. The method may be employed to prevent fluctuations in system pressure that might otherwise result from abrupt pump shutdown and startup when one pump takes over operation for another, such as may occur as a result of pump malfunction or scheduled pump switchover as described above.

At step 900, a first of the pumps 16-20 that is to be shut down will send a request to a second of the pumps 16-20 that is to take over operation for the first pump. If the communication link 46 is in good condition and the second pump is able to receive the request and successfully start up, the second pump may, at step 910, send an acknowledgement back to the first pump. Subsequently, if the communication link 46 is still in good working condition and the first pump receives the acknowledgment from the second pump, the first pump may, at step 920, prepare to shut down. However, if the communication link 46 is not in good working condition and the first pump does not receive an acknowledgment from the second pump in a predetermined amount of time, the first pump may, at step 930, continue to operate normally without shutting down if it is not under critical shut-down alarms.

The above-described "hand-off" operation from the first pump to the second pump may be performed in a simple, timed manner, wherein the first pump continues to operate at its then-current speed for a predetermined amount of time after receiving an acknowledgement from the second pump. Alternatively, the hand-off may be performed in a graduated manner, wherein the speed of the first pump is reduced or ramped down while the speed of the second pump simultaneously increased or ramped up at a substantially identical rate. The latter hand-off method may achieve a more stable system pressure during the transition from the first pump to the second pump.

The exemplary method set forth in FIG. 9 thus facilitates smooth and automatic transitions between the pumps 16-20 in the system 10 in a manner that prevents, or at least mitigates, abrupt lapses in system pressure that could otherwise cause system operation disruptions.

As used herein, the term "computer" may include any processor-based or microprocessor-based system including systems using microcontrollers, reduced instruction set circuits (RISCs), application specific integrated circuits (ASICs), logic circuits, and any other circuit or processor capable of executing the functions described herein. The above examples are exemplary only, and are thus not intended to limit in any way the definition and/or meaning of the term "computer."

The computer system executes a set of instructions that are stored in one or more storage elements, in order to process input data. The storage elements may also store data or other information as desired or needed. The storage element may be in the form of an information source or a physical memory element within the processing machine.

The set of instructions may include various commands that instruct the computer as a processing machine to perform specific operations such as the methods and processes of the various embodiments of the invention. The set of instructions may be in the form of a software program. The software may be in various forms such as system software or application software. Further, the software may be in the form of a collection of separate programs, a program module within a larger program or a portion of a program module. The software also may include modular programming in the form of object-oriented programming. The processing of input data by the processing machine may be in response to user commands, or in response to results of previous processing, or in response to a request made by another processing machine.

As used herein, the term "software" includes any computer program stored in memory for execution by a computer, such memory including RAM memory, ROM memory, EPROM memory, EEPROM memory, and non-volatile RAM (NVRAM) memory. The above memory types are exemplary only, and are thus not limiting as to the types of memory usable for storage of a computer program.

The invention claimed is:

1. A seawater cooling system adapted to mitigate salt crystallization in a seawater cooling loop, the system comprising:

a pump operatively connected to the cooling loop and configured to pump seawater through the cooling loop for circulating through a heat exchanger;

a temperature sensor operatively connected to a discharge side of the heat exchanger of the cooling loop and configured to monitor a temperature of the seawater in the cooling loop; and a controller operatively connected to the temperature sensor and to the pump, the controller configured to increase a speed of the pump when the controller determines, from a signal received from the temperature sensor, that a monitored temperature of the seawater exceeds a predetermined threshold temperature that is below an alarm temperature indicating salt crystallization formation in the seawater cooling loop.

2. The seawater cooling system of claim 1, wherein the controller is configured to issue a warning when the controller determines that the monitored temperature of the seawater exceeds the predetermined threshold temperature.

3. The seawater cooling system of claim 1, wherein the controller is configured to issue an alarm when the controller determines that the monitored temperature of the seawater exceeds the alarm temperature such that the monitored temperature of the seawater exceeds the predetermined threshold temperature by a predetermined amount.

4. The seawater cooling system of claim 3, wherein the predetermined amount is 5 degrees Celsius or less.

5. The seawater cooling system of claim 1, wherein the controller is configured to reduce the speed of the pump when the controller determines, from a signal received from the temperature sensor, that the monitored temperature of the seawater is less than the predetermined threshold temperature.

6. The seawater cooling system of claim 1, wherein the pump comprises a plurality of pumps operatively connected to the cooling loop and configured to pump seawater through the cooling loop, wherein the controller comprises a plurality of controllers operatively connected to a respective one of said plurality of pumps, and wherein the temperature sensor is operatively coupled to at least one of said plurality of controllers to provide signals representative of a temperature of the seawater in the cooling loop.

7. The seawater cooling system of claim 6, wherein the plurality of controllers are configured to adjust an operating speed of the respective plurality of pumps dependent upon the signals received from the temperature sensor.

8. The seawater cooling system of claim 2, wherein in response to the issued warning, the controller is configured to command the pump to operate at a maximum rated speed regardless of cooling demands of an engine.

* * * * *